United States Patent [19]

Long et al.

[11] 4,384,285

[45] May 17, 1983

[54] DATA CHARACTER VIDEO DISPLAY SYSTEM WITH VISUAL ATTRIBUTES

[75] Inventors: Nicholas R. Long, Hudson, N.H.; Joseph L. Ryan, Tuscon, Ariz.; John P. Stafford, Nashua, N.H.; Richard R. Watkins, Chelmsford, Mass.

[73] Assignee: Honeywell Information Systems Inc., Waltham, Mass.

[21] Appl. No.: 235,808

[22] Filed: Feb. 19, 1981

[51] Int. Cl.[3] ..... G09G 1/02

[52] U.S. Cl. ..... 340/723; 340/798

[58] Field of Search ..... 340/721, 723, 728, 731, 340/747, 748

[56] References Cited

U.S. PATENT DOCUMENTS

| | | | |
|---|---|---|---|
| 3,659,283 | 4/1972 | Ophir | 340/731 |
| 3,895,374 | 7/1975 | Williams | 340/723 |
| 4,290,063 | 9/1981 | Traster | 340/723 |

*Primary Examiner*—David L. Trafton

*Attorney, Agent, or Firm*—George Grayson; Nicholas Prasinos

[57] ABSTRACT

A logic system is provided in a video system for accommodating the display of video data characters and the application of visual attributes to such characters whether occurring singularly or in fields.

3 Claims, 8 Drawing Figures

VIDEO DRIVE LOGIC
SHIFT REGISTER
PI
SI
PL
CLK
72
ROM CHARACTER GENERATOR
70
63
71
52
EN
REGISTER
CLK
50
62
73
74
75
D
Q
FLIP/FLOP
CLK
76
77
78
79
VIDEO DRIVE LOGIC
82
EN
REGISTER
CLK
83
64
57
EN
REGISTER
CLK
81
62
55

DATA CHARACTER VIDEO DISPLAY SYSTEM WITH VISUAL ATTRIBUTES

BACKGROUND OF THE INVENTION

The present invention relates to data display systems such as video terminals, and more particularly to apparatus for providing data characters to video display logic, and for selectively controlling the application of visual attributes to the display of the video characters.

PRIOR ART

Video terminal systems have employed either complex formatting and tracking logic circuitry or an expanded CPU control to accommodate the application of visual attributes to the display of data characters. More particularly, such a display requires that a space be inserted between the characters for quick recognition and comprehension. Further, the application of visual attributes such as an underlining, a blinking effect, a highlighting, a reverse video effect, etc., may be required for data characters occurring singularly or in character strings.

In the present invention, the duplication of components, the use of complex logic tracking circuitry, and the need for increased CPU control has been substantially obviated in a manner providing increased flexibility in accommodating the video display of data characters with visual attributes, whether such data characters occur singularly or in character strings.

SUMMARY OF THE INVENTION

A simplistic logic system for a video terminal display system is provided for accommodating the application of visual attributes to data character displays.

More particularly, a video ROM memory has stored therein data characters. When binary address codes comprised of a character code and a scan line count is received from a video control system and applied to the ROM, binary character data is parallel loaded into a video shift register for application as a serial information stream to the video drive logic controlling the display of characters on a video screen.

The video control system also supplies visual attribute codes to a visual attribute holding register. A bit position of a binary visual attribute code stored in the holding register is sensed to indicate whether a visual attribute stored in a video output register is to be changed. Until such time as the video control system changes the logic level of the bit position in the holding register, the contents of the holding register are not loaded into the output register. A single visual attribute thereby may be appllied to a single character, or to a field of consecutively occurring characters under the control of the video control system.

DESCRIPTION OF THE DRAWINGS

For a more complete understanding of the present invention and for further objects and advantages thereof, reference may now be had to the following description taken in conjunction with the accompanying drawings in which.

DESCRIPTION OF THE PREFERRED EMBODIMENT

FIG. 1

Figure 1:
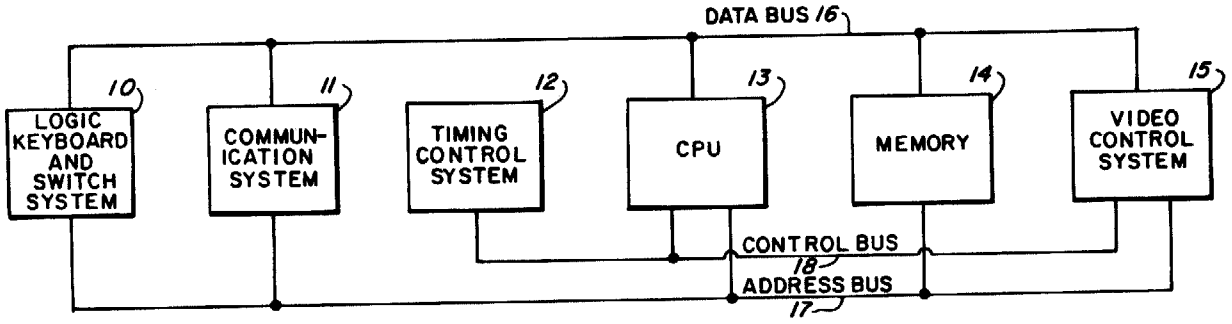
FIG. 1 is a functional block diagram of a video terminal display system having system components electrically coupled to common data, address, and control busses.

FIG. 1 illustrates in functional block diagram form a video terminal display system comprising a logic keyboard and switch system 10, a communication system 11, a timing control system 12, a central processing unit (CPU) 13, a memory unit 14 and a video control system 15. Communication between the devices comprising the video terminal display system is accomplished by way of an eight bit bidirectional data bus 16, a sixteen bit address bus 17, and a four bit control bus 18.

The logic system 10 and the communication system 11 provide means for entering data into the display system. More particularly, a user may enter data manually by way of logic system 10, or data may be entered from a host CPU by way of communication system 11. The timing control system 12 generates the system bus timing cycles for the data bus 16, the address bus 17, and the control bus 18.

In the preferred embodiment disclosed herein, the memory unit 14 is comprised of a 1.0K by 8.0 bit random access memory (RAM), and a 6.0K by 8.0 bit read only memory (ROM). Microprogrammed subroutines are stored in the ROM to control overall system operation. Sections of the RAM, however, are set aside as registers, buffers, and work areas to be used during system operation. The memory unit 14 is accessed only by the CPU 13 by way of address bus 17. During a memory read cycle, a data word is read from the memory unit to the data bus 16. During a memory write cycle, a data word is received from the CPU 13 by way of data bus 16, and is written into the memory location addressed by the CPU on the address bus 17. The CPU 13 thus reads or writes into the RAM of the memory unit 14 to accommodate necessary system bookkeeping, and controls the overall system operation through access to the microprogrammed subroutines stored in the ROM of the memory unit 14.

The CPU 13 further may access the logic system 10 or communication system 11 by way of address bus 17 to transfer data received from such systems to either the memory unit 14 or the video control system 15. In addition, the CPU may access memory units within the video control system 15 to either write video data into such memory units, or to read video data stored in the memory units for transfer to the logic system 10 or communication system 11.

A brief description of control signals generated and received by the timing control system 12 by way of control bus 18 during system operation are described below:

CPURWC+00 (CPU Read Write Control)

The CPU Read Write Control signal indicates the type of data transfer occurring on the data bus 16. When the signal is at a logic one level during a CPU cycle, data is read from a device such as memory unit 14 to the data bus 16 under CPU control. When the signal is at a logic zero level, data on the data bus 16 is written under CPU control into the memory unit 14.

BRESET−00 (Bus Reset)

The Bus Reset signal is used by the CPU 13 to clear registers and reset flip-flops throughout the video terminal display system. System reset occurs when the signal transitions to a logic zero level.

CPUVMA+00 (CPU Valid Memory Address)

The CPU valid memory address signal indicates the occurrence of a time period during which memory address signals appearing on the address bus 17 are valid. When the CPU signal is at a logic zero level, the memory address lines are invalid. When the CPU signal is at a logic one level, however, the memory address lines are valid and may be used.

CPUIRO−00 (CPU Interrupt Request)

The CPU interrupt request signal indicates to the CPU that a device on a system bus requires servicing. When the signal is at a logic one level, no servicing is required. When the signal is at a logic zero level, however, the CPU is interrupted to terminate any existing program execution and to initiate a service routine program for the interrupting device.

The invention disclosed herein is embodied in the video control system 15 which controls the access to a display memory internal to the control system as shall be further described.

FIG. 2

Figure 2:
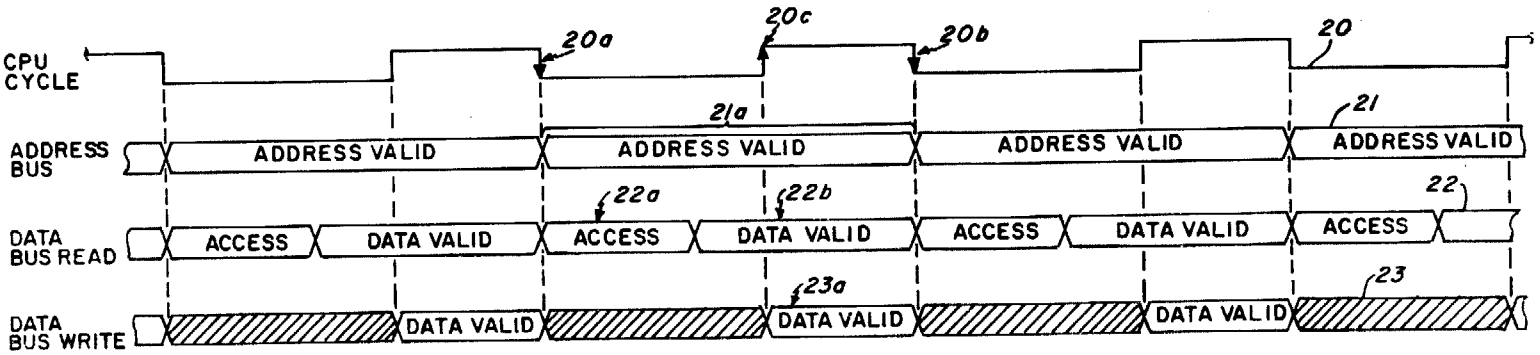
FIG. 2 is a timing diagram of bus cycles occurring in the common busses of FIG. 1.

FIG. 2 illustrates in timing graph form the bus cycles occurring in the address bus 17 and the data bus 16 of FIG. 1.

A waveform 20 illustrates the CPU 13 duty cycles during which the CPU controls all transactions occurring on system busses including data bus 16, address bus 17, and control bus 18. A waveform 21 illustrates the address bus refresh cycle during which the CPU 13 issues a device address to the bus. A waveform 22 illustrates bus cycles occurring on the data bus 16 during a data read operation. A waveform 23 illustrates bus cycles occurring on the data bus 16 during a data write operation.

During a data read operation, the CPU issues a device address to the address bus 17 upon the occurrence of a trailing edge of a CPU cycle as illustrated at 20*a*. The device address remains on the address bus during the following CPU cycle as illustrated at 21*a*. Following an access delay as illustrated at 22*a*, the addressed device issues a data byte to the data bus 16 as illustrated by the time period 22*b*. The CPU 13 operates upon the data byte or transfers the data byte to another device upon the occurrence of a next trailing edge in the waveform 20 as illustrated at 20*b*.

In a data write operation, the CPU 13 as before described issues a device address to the address bus 17 upon the occurrence of a trailing edge of a CPU cycle as illustrated at 20*a*. Upon the occurrence of a next rising edge of the waveform 20 as illustrated at 20*c*, the CPU places data on the data bus 16 as illustrated by the time period 23*a*. The device addressed by the CPU on the address bus 17 thereupon samples the data on data bus 16 prior to the occurrence of a next trailing edge of a CPU cycle as illustrated at 20*b*.

FIG. 3

Figure 3:
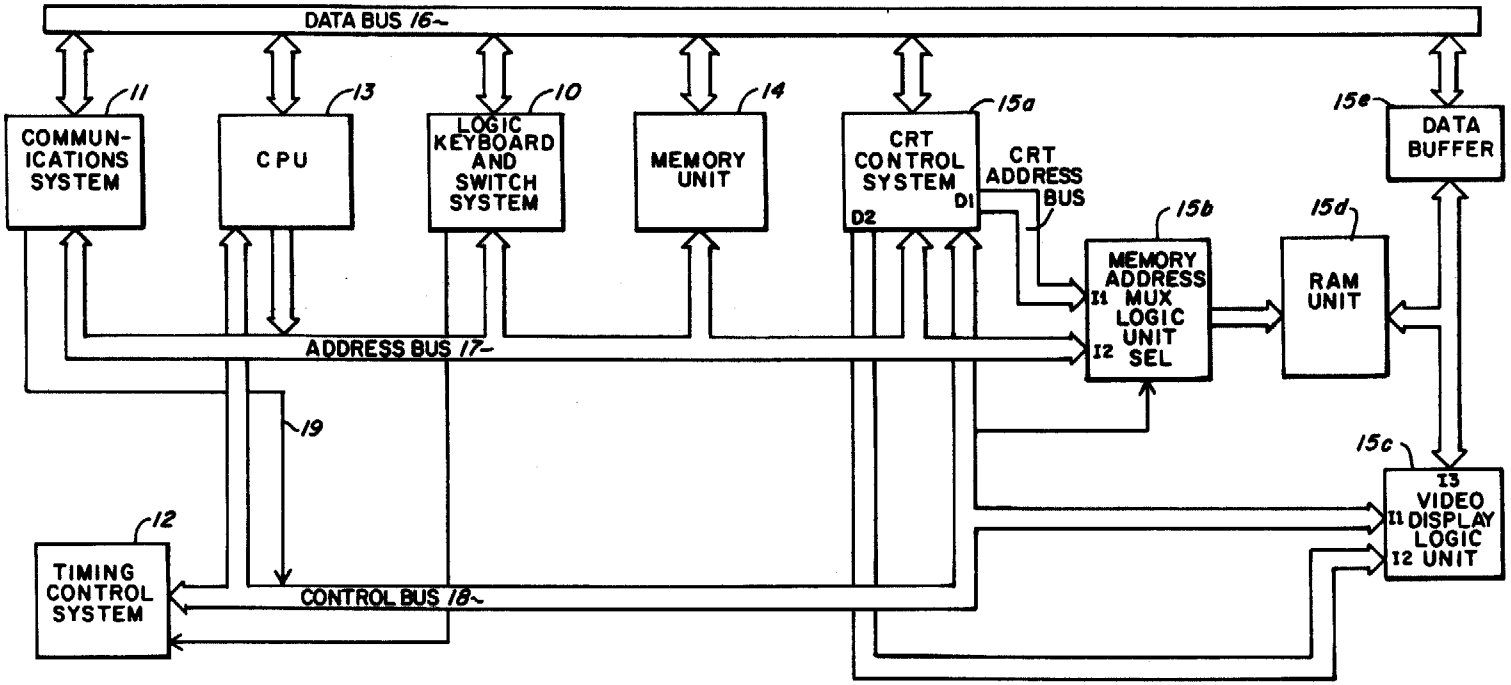
FIG. 3 is a detailed functional block diagram of the video terminal display system of FIG. 1.

FIG. 3 illustrates in functional block diagram form the video terminal display system of FIG. 1 including a more detailed block diagram of the video control system 15. It is to be understood that the use of like reference numbers in FIGS. 1 and 3 indicates like logic devices.

Referring to FIG. 3, a CRT control system 15*a* is in electrical communication with data bus 16, address bus 17 and control bus 18. An eleven-bit D1 output of the control system is applied to the I1 input of a memory address multiplexer logic unit 15*b*, and a four-bit D2 output of the control system is applied to the I2 input of a video display logic unit 15*c*. The I2 input of the multiplexer logic unit 15*b* is connected to the address bus 17, and the output of the multiplexer logic unit is applied to the input of a 2.0K by 16.0 bit random access memory (RAM) unit 15*d*. A character clock signal to be later described is applied by the timing control system 12 along the control bus 18 to the SEL (select) input to the multiplexer logic, to the I1 input of the video display logic unit 15*c* and to the I2 input of the CRT control system 15*a*.

The I3 input of the video display logic unit is connected to a sixteen-bit input/output of RAM unit 15*d* and to an input/output of an eight-bit data buffer 15*e*. A second input/output of the data buffer is connected to the data bus 16.

The CRT control system 15*a*, memory address multiplexer logic unit 15*b*, video display logic unit 15*c*, RAM unit 15*d* and data buffer 15*e* comprise the video control system 15 of FIG. 1.

In operation, the video terminal display system may receive video data from the logic keyboard and switch system 10, or from a host CPU by way of the communication system 11. If data is supplied by a host CPU, the data is accepted by the communication system 11 and formed into an eight-bit video character code. The communication system thereupon generates a first interrupt by way of the control line 19 to the timing control system 12. In response thereto, the system 12 generates a second interrupt through the control bus 18 to the CPU 13. Upon receiving the second interrupt, the CPU applies a twelve-bit address code to the address bus 17 to store the video character code of the communication system 11 in either the memory unit 14, or in the RAM unit 15*d* by way of the data buffer 15*e*. The memory unit 14 is used as a temporary storage for video data in the event bus access conflicts occur. When the time conflicts have been overcome, the CPU shall retrieve the video data from memory unit 14 for storage in the RAM unit 15*d*.

When the CPU 13 applies a memory address code to the I2 input of the multiplexer logic unit 15*b*, and the multiplexer logic unit is selected by the timing control system 12 under CPU control to the I2 input, a binary video character or visual attribute code stored in the data buffer 15*e* may be written into the addressed memory location of the RAM unit 15*d*. In the alternative, data stored in the addressed memory location may be read for storage in the data buffer 15*e*. More particularly, if video data stored in the RAM unit 15*d* is to be transferred by way of the communication system 11 to a host CPU, the CPU 13 shall issue a twelve-bit address code by way of the multiplexer logic unit 15*b* to the RAM unit 15*d*. The output of the RAM unit thereupon is applied through the data buffer 15*e* under CPU control to the data bus 16. The communication system 11 thereafter may forward the data on the data bus to the host CPU.

If video data is entered by way of the logic keyboard and switch system 10 rather than the communication system 11, the system 10 may generate an interrupt to the timing control system 12. The operation of the system thereafter is as before described.

At the time of system initialization, the CPU 13 addresses the CRT control system 15*a* by way of the system address bus 17, and issues a write enable signal on the control bus 18. The CPU thereafter writes configuration data appearing on the data bus 16 into the configuration control registers of the control system. The configuration data includes scan line count, character position count, characters per scan line, cursor position, and initial RAM address information.

During system operation, the CRT control system 15*a* generates sequential address codes at its D1 output to address the RAM unit 15*d*. In addition, the control system generates horizontal sync, vertical sync, screen blanking and other timing signals at its D2 output for controlling the display of information on a video screen. More particularly, when character data and visual attribute data stored in the RAM unit 15*d* are to be supplied to the video display logic unit 15*c*, the CRT control system 15*a* issues eleven bit address codes to the I1 input of the logic unit 15*b* at a 1.88 Mhz character clock rate. Eight bit segment pairs of the RAM unit are addressed in response to each address code, and sixteen bit data words stored in the addressed memory locations are applied to the I3 input of the video display logic unit 15*c*. The video display logic unit 15*c* interprets each data word as being comprised of eight bits of character data and eight bits of visual attribute data.

FIG. 4

Figure 4:
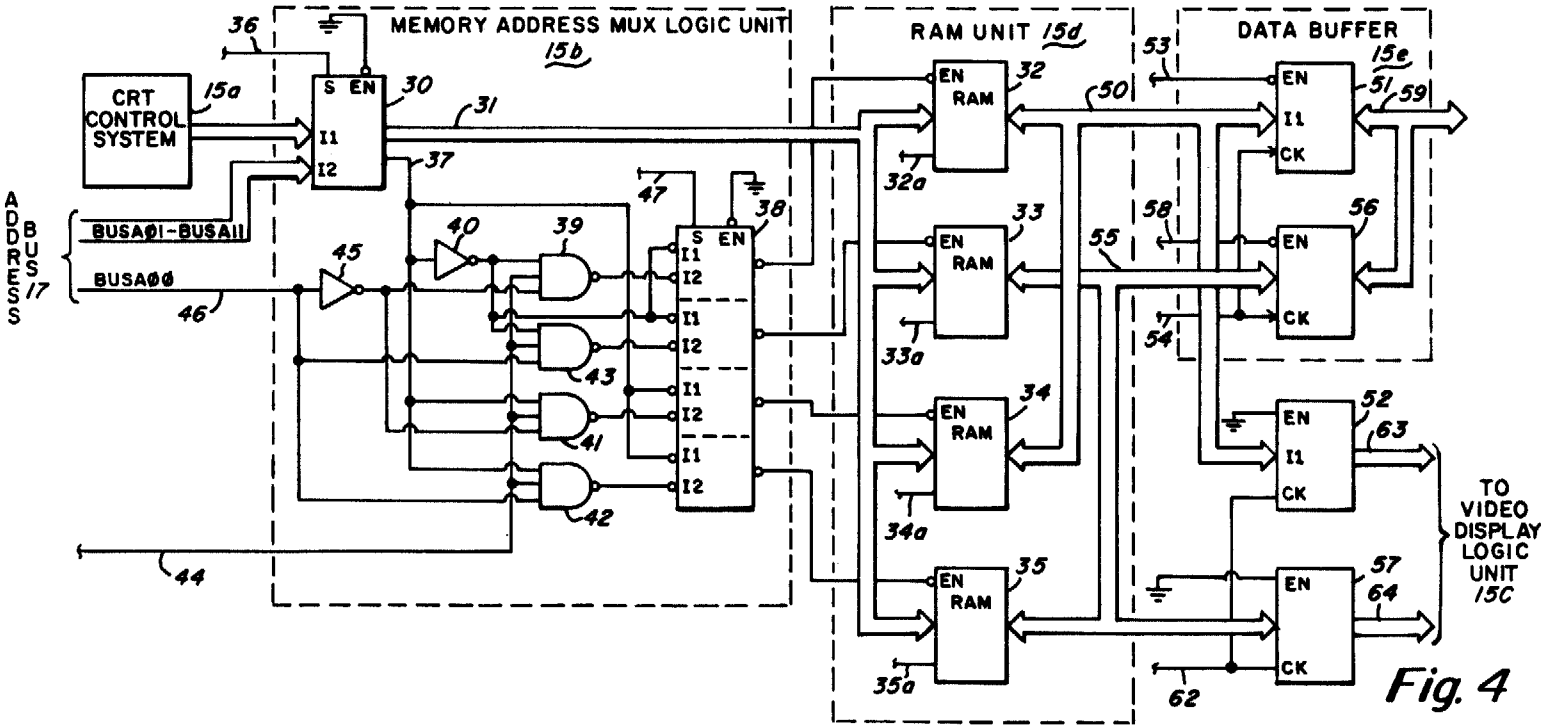
FIG. 4 is a detailed logic diagram of the memory address multiplexer logic unit, the RAM unit and the data buffer of FIG. 3.

FIG. 4 illustrates in a more detailed logic diagram form the memory address multiplexer logic unit 15*b*, the RAM unit 15*d*, and the data buffer 15*e* of FIG. 3.

In referring to the electrical schematics illustrated in the Figures, it is to be understood that the occurrence of a small circle at the input of a logic device indicates that the input is enabled by a logic zero. Further, a circle appearing at an output of a logic device indicates that when the logic conditions for that particular device are satisfied, the output will be a logic zero.

Referring to FIG. 4, the CRT control system 15*a* as before described supplies an eleven bit address to the I1 input of the logic unit 15*b*. More particularly, the output of system 15*a* is applied to the I1 input of a multiplexer 30 comprising a component part of the logic unit 15*b*. The I2 input of multiplexer 30 is an eleven-bit input supplied by way of the address bus 17. The select input to the multiplexer 30 is connected to a control line 36 leading to a time divided character clock output of the timing control system 12 of FIG. 3. The enable input to the multiplexer 30 is connected to ground.

A ten-bit output of multiplexer 30 is applied by way of a data bus 31 to a 1.0K×8.0-bit RAM 32, a 1.0K×8.0-bit RAM 33, a 1.0K×8.0-bit RAM 34, and a 1.0K×8.0-bit RAM 35. The most significant bit output of the multiplexer 30 is applied to a control line 37 leading to the I1 input of the third and fourth stages of a four-stage multiplexer 38. The most significant bit output of multiplexer 30 further is applied to one input of a NAND gate 39 by way of an inverter 40, to one input of a NAND gate 41 and to one input of a NAND gate 42.

The output of the inverter 40 also is applied to one input of a NAND gate 43, and to the I1 inputs of the first and second stages of multiplexer 38. A second input to the NAND gates 39, 41, 42 and 43 is a logic signal supplied by a control line 44 leading from the timing control system 12 of FIG. 3. The logic signal is issued at such a time as to ensure that the RAM unit 15*d* is not enabled before a write mode select control signal issued by the CPU 13 is received by the RAM unit during a data write operation. A third input to the NAND gate 39 is supplied by the output of an inverter 45, the input of which is connected to an address line 46 carrying the least significant bit signal of the address bus 17. The output of inverter 45 further is connected to a third input of gate 41. The control line 46 also is connected to a third input of the NAND gate 43 and to a third input of the NAND gate 42.

The output of the NAND gate 39 is applied to the I2 input of the first stage of the multiplexer 38, and the output of the NAND gate 43 is supplied to the I2 input of the second stage of the multiplexer. The output of the NAND gate 41 is applied to the I2 input of the third stage of the multiplexer 38, and the output of the NAND gate 42 is applied to the I2 input of the fourth stage of the multiplexer. The select input to the multiplexer 38 is a time divided characterclock signal supplied by the timing control system 12 of FIG. 3 by way of a control line 47, and the enable input of the multiplexer is connected to ground.

The multiplexers 30 and 38, the inverters 40 and 45, and the gates 39, 41, 42 and 43 comprise the address multiplexer logic unit 15*b* of FIG. 3.

The first stage output of the multiplexer 38 is applied to the enable input of the RAM 32, and the second stage output of the multiplexer is applied to the enable input of RAM 33. The third stage output of the multiplexer 38 is supplied to the enable input of RAM 34, and the fourth stage output of the multiplexer is supplied to the enable input of RAM 35.

An input/output port of RAM 32 is connected by way of a bidirectional tri-state communication bus 50 to the I1 input of an eight-bit register 51. The bus 50 further is connected to an input/output port of the RAM 34, and to the I1 input of an eight-bit holding register 52. The enable input to the register 51 is supplied by the timing control system 12 by way of a control line 53, and the clock input to the register is a time divided character clock signal supplied by the timing control system by way of a control line 54.

An input/output port of RAM 33 is applied to a bidirectional tri-state communication bus 55, which also is connected to the input of an eight-bit register 56, to the input of an eight-bit register 57, and to an input/output port of RAM 35.

The read/write mode select (R/W) inputs to the RAMs 32–35 are supplied by the CPU 13 by way of control lines 32*a*, 33*a*, 34*a*, and 35*a*, respectively.

The enable input of register 56 is connected to a control line 58 leading from an output of the timing control system 12, and the clock input to the register is connected to control line 54. An input/output port of register 56 is connected by way of a bi-directional tri-state bus 59 to the data bus 16 of FIG. 3 and to the output of the register 51. The enable input to registers 52 and 57 are connected to the ground. The clock inputs to registers 52 and 57 are connected to a control line 62 leading from a time divided character clock output of the timing control system 12. The output of the register 52 is an eight-bit output which is applied by way of a data bus 63 to the video display logic unit 15*c* of FIG. 3. The output of the eight-bit register 57 is applied by way of a data bus 64 to the video display logic unit.

The RAMS 32, 33, 34 and 35 comprise the RAM unit 15*d* of FIG. 3. In the preferred embodiment disclosed herein, the RAMs comprising RAM unit 15*d* may be of the type manufactured and sold by the Intel Corporation of Santa Clara, Calif., and identified to the public as RAM 2114AL-4. The registers 51 and 56 comprise the data buffer 15*e* of FIG. 3.

In operation, the timing control system 12 of FIG. 3 generates clock signals from a 16.948 MHz oscillator as shall be further described to control the operation of the multiplexers 30 and 38, gates 39 and 41–43, data buffer 15*e* and registers 52 and 57. During a video data refresh cycle, the CRT control system 15*a* applies an 11-bit address code by way of the multiplexer 30 to a control line 37 and to the 10-bit data bus 31 addressing RAMs 32–35. When the most significant bit output of the multiplexer 30 on control line 37 is at a logic one level, the stage I and stage II outputs of multiplexer 38 enable RAMs 32 and 33. When the control line 37 is at a logic zero level, however, the stage III and stage IV outputs of multiplexer 38 enable the RAMs 34 and 35. The RAMs 32 and 34 have binary video character codes stored therein, while the RAMs 33 and 35 contain binary visual attribute codes. The RAMs 32 and 34 have same memory location addresses, and the RAMs 33 and 35 have same memory location addresses succeeding those of RAMs 32 and 34. Whether the RAMs 32 and 33 or the RAMs 34 and 35 are addressed and enabled, the output of the RAMs are latched into the holding registers 52 and 57 pending transfer to the video display logic unit 15*c* of FIG. 3.

During a CPU read or write cycle, twelve bits of address information are supplied by way of the address bus 17 to control line 46 and multiplexer 30. The eleven most significant bits are applied through the multiplexer to the data bus 31 and control line 37, collectively. A least significant bit logic signal is applied to the control line 46.

The control line 37 selects between a first RAM pair comprised of the RAMs 32 and 33, and a second RAM pair comprised of the RAMs 34 and 35. The control line 46, however, selects between the RAMs comprising a selected RAM pair. Thus, during a CPU cycle, a video character RAM 32 or 34 is selected if the control line 46 is at a logic zero level. If the control line is at a logic one level, however, a visual attribute RAM 33 or RAM 35 is selected. If the RAM 32 or the RAM 34 is selected, the output of the RAM is latched into register 51 or register 52. If the RAM 33 or the RAM 35 is selected, however, the output of the RAM is latched into register 56 or register 57. The registers 51 and 56 are electrically connected by way of the tri-state bus 59 to the data bus 16 of FIG. 3. The video character codes stored in register 52 and the visual attribute codes stored in register 57 are forwarded to the video display logic unit 15*c* of FIG. 3.

FIG. 5

Figure 5:
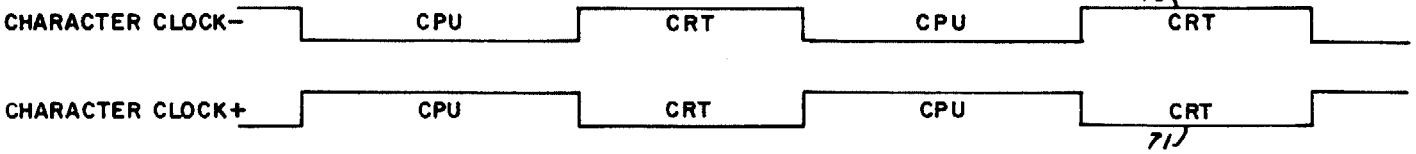
FIG. 5 is a timing diagram of the operation of the logic system of FIG. 4.

FIG. 5 illustrates in timing graph form the operation of the logic system of FIG. 4.

Referring to FIG. 5, waveforms 70 and 71 illustrate time divided character clock signals one hundred-eighty degrees out of phase. In the preferred embodiment disclosed herein each signal is derived from a 16.948 MHz signal, and exhibits a full cycle time period (T) of approximately 531.0 nanoseconds. The cycle time period is comprised of a (5T/9) CPU time period and a (4T/9) CRT time period.

The character clock signal of waveform 70 is applied to the select input of multiplexer 30, and to the clock inputs of registers 51 and 56 of FIG. 4. The character clock signal of waveform 71 is applied to the select input of multiplexer 38, and to the clock inputs of registers 52 and 57 of FIG. 4.

In operation, the multiplexers 30 and 38 act in concert to provide the CPU 13 and the CRT control system 15*a* access to the RAM unit 15*d*. During the time period that waveform 70 is at a logic one level and waveform 71 is at a logic zero level, the CRT control system 15*a* may address the RAM unit. The CPU 13 may address the RAM unit during those time periods that the waveform 70 is at a logic zero level and the waveform 71 is at a logic one level. Further, data may be written into the registers 52 and 57 when the waveform 71 is at a logic one level, and data may be written into registers 51 and 56 when waveform 70 is at a logic one level.

FIG. 6

Figure 6:
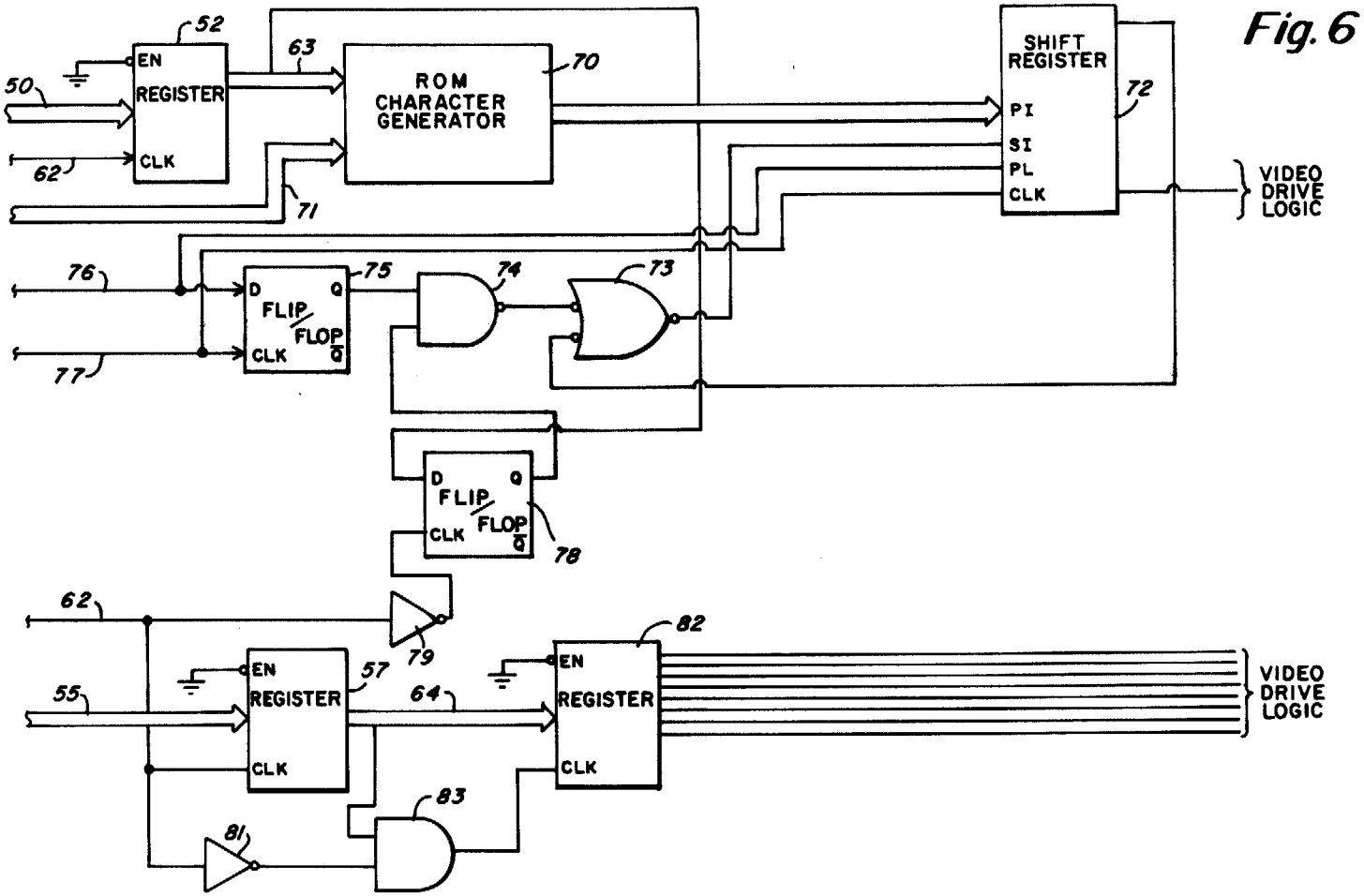
FIG. 6 is a detailed logic diagram of the invention.

FIG. 6 illustrates the invention in detailed logic diagram form.

Referring to FIG. 6, the holding register 52 of FIG. 4 receives character data by way of the bi-directional tri-state bus 50. As before described, the enable input to the register 52 is connected to ground, and a character clock control signal is supplied by the timing control system 12 by way of the control line 62 to the clock input of the register. The output of the register 52 constitutes eight bits of a twelve-bit address which is applied to a 2.0K×8.0 bit ROM character generator 70. The remaining four bits of the twelve bit address to the ROM are supplied by the D2 output of the CRT control system 15*a* of FIG. 4 by way of a four data bus 71.

In response to the twelve bit address, the ROM character generator 70 supplies a data character to the parallel input (PI) of an eight-bit video shift register 72. The most significant bit output, bit 7, of the shift register is applied to one input of an OR gate 73, a second input to which is supplied by a NAND gate 74. The output of gate 73 is applied to the serial input (SI) of the shift register.

A first input to the gate 74 is supplied by the Q output of a D-type flip-flop 75. The D input to the flip-flop is supplied by the timing control system 12 on a control line 76 which also is connected to the parallel load (PL) input of the video shift register 72. The clock input to the flip-flop 75 is supplied by the timing control system 12 on a control line 77 which further is connected to the clock input of the video shift register 72.

A second input to the NAND gate 74 is connected to the Q output of a D-type flip-flop 78. The D input to the flip-flop is connected to the most significant bit, bit 7, output of the register 52, and the clock input to the flip-flop is connected to the output of an inverter 79. The input to the inverter is connected to control line 62, to the clock input of register 57 and to the input of an inverter 81.

The enable input to register 57 is connected to ground. The data input to the register 57 is connected to bus 55, and the output of the register is applied to the input of an eight-bit register 82. The least significant bit output of the register 57 also is applied to one input of an AND gate 83, the output of which is applied to the clock input of register 82. A second input to gate 83 is connected to the output of inverter 81.

The least significant bit output of video shift register 72 and the output of register 82 are applied to video drive logic controlling the operation of a cathode ray tube or similar video display device.

In operation, eight bits of character data are stored in the register 52 and eight bits of visual attribute data are stored in the register 57 as before described. The character data in the register 52 is applied by way of the data bus 63 to one input of the ROM character generator 70. In addition, four bits of scan line count information is supplied by the D2 output of the CRT control system 15*a* of FIG. 3 to data bus 71. The register 52 and data bus 71 collectively provide a twelve-bit address to the ROM character generator. In response thereto, an eight-bit video or graphic character code stored in the ROM character generator is supplied to the PI input of the video shift register 72. Responsive to a 1.883 MHz clock control signal supplied by the timing control system 12 on control line 76, the character code is parallel loaded into the video shift register 72. The character code is thereafter serially shifted through the shift register in response to a 16.948 MHz bit clock control signal supplied by the timing control system 12 on control line 77. The least significant bit output of the shift register 72 is provided to video drive logic for display on a CRT. Since the video drive logic is not a part of the present invention, and is not necessary for the operation of the invention, it shall not be further described.

Not only video character codes, but also graphic character codes are stored in the ROM character generator 70. Graphic characters typically are vertical and horizontal lines which may be connected to form a graphic symbol for display. In the event that graphic character codes are addressed in the ROM character generator 70, the most significant bit output of register 52 shall be at a logic one level. At the beginning of a next character time period, as shall be further explained, the Q output of flip-flop 78 transitions to a logic one level, and a character code is parallel loaded from the ROM character generator 70 into the video shift register 72. During a first serial bit shift of the video shift register 72, the Q output of flip-flop 75 transitions to a logic one level to cause the Q output of flip-flop 78 to be gated through the AND gate 74 to gate 73. If the most significant bit output of shift register 72 is at a logic one level, the logic one level is applied through gate 73 to the SI input of the video shift register 72. As a result, the logic level occurring in the bit 7 output of the video shift register 72 shall be repeated in the ninth bit cell time period of the serial video stream supplied by the video shift register to the video drive logic. The format of graphic characters thereby may be made compatible to that of video characters.

In the display of information on a video screen, either a character attribute mode or a field attribute mode may be selected by means of the logic keyboard and switch system 10 of FIG. 3. In a character attribute mode, the attribute is associated with a particular character. In a line of characters on a display, therefore, only a selected character shall be affected by such attributes as an underline, an inverse video effect, a blinking, etc. If a field attribute mode is selected, however, an entire field of characters may be affected by the indicated attributes.

In the character attribute mode, an attibute flag bit is included in each visual attribute data byte stored in register 57. In the field attribute mode, however, an attribute flag bit is stored only in those visual attribute data bytes for which a change in the visual attribute being displayed is desired.

In the event a character attribute mode is selected, an attribute clock bit shall occur in the bit 0 output of the register 57. Upon the occurrence of a logic zero in the clock signal applied by the timing control system 12 to the control line 62, the bit 0 output of the register 57 is applied through the gate 83 to the clock input of the register 82. During each character time period in which a character code is loaded from the ROM character generator 70 into the video shift register 72, attribute data stored in the register 57 is transferred to the register 82.

In the event that a field attribute mode is selected, the bit 0 output of the register 57 transitions to a logic one level only when the attribute data in the register 82 is to be changed. In this manner, the same attribute information in the register 82 may be applied to a field of contiguous characters supplied by the video shift register 72 to the video drive logic.

In accordance with the invention, visual attributes may be applied to the display of video characters occurring singularly or in character strings, and further may be applied to the display of both graphic characters and graphic symbols comprised of a plurality of connected graphic characters.

FIG. 7

Figure 7:
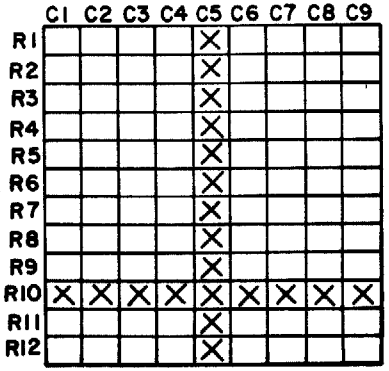
FIG. 7 is a graphic diagram of a graphic character.

FIG. 7 illustrates in graphic form the type of graphic characters which may be stored in the ROM character generator 70 of FIG. 6.

In the preferred embodiment described herein, each character space occurring on a video display is 9 bits wide and 12 bits in height. ASCII data characters stored in the ROM character generator 70 normally are 7 bits wide to accommodate a 2 bit cell space between characters. As before described, graphic characters are comprised of vertical and horizontal lines which must be connected without spaces therebetween to construct a graphic symbol for display. In order to accommodate the display of both ASCII data characters and graphic characters without requiring the addition of a second ROM character generator or complex logic tracking circuitry, the 8 bit wide output of the ROM character generator 70 must be revised to provide an apparent 9 bit wide graphic data character.

Referring to FIG. 7, a first graphic character comprised of a vertical line is located in column 5, C5, of the graph and is one bit wide and 12 bits in height. A graphic character in the form of a horizontal line in row 10, R10, of the graph, however, is 8 bits wide due to the limitation in width of the ROM character generator 70. In order to connect a horizontal line as shown in row 10 of the graph to a next line to form a graphic symbol for display, it is necessary that contiguous lines be connected. In order to accomplish this task, the bit position in row 10, column 9 of the graph must be filled. This is accomplished by the logic circuitry illustrated in FIG. 6 wherein the logic level in the row 10, column 8 bit position is repeated in the row 10, column 9 bit position.

If a vertical line such as that illustrated in column 5 of the graph is to be displayed, the logic levels of the bit positions represented by row 1 of the graph are loaded into the video shift register 72. Rows 2–12 thereafter are loaded consecutively into the shift register. If the horizontal line represented by the bit positions of row 10 is to be displayed, the column 1 through column 8 bit positions of row 10 are parallel loaded into the 8 bit video shift register 72, and the logic level of the column 8 bit position is repeated in the column 9 bit position of the serial information stream provided by the shift register to develop a 9 bit wide character for display.

FIG. 8

Figure 8:
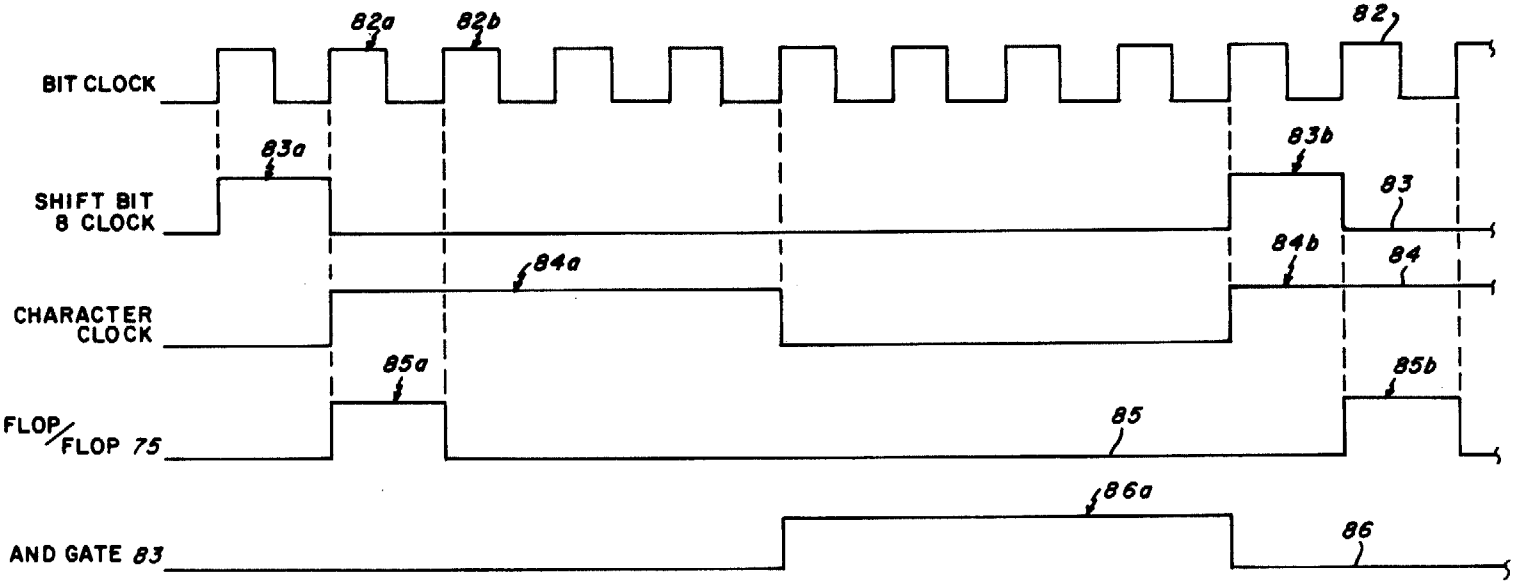
FIG. 8 is a timing diagram of the operation of the invention.

FIG. 8 illustrates in timing graph form the operation of the logic system of FIG. 6.

Referring to FIG. 8, a first waveform 82 illustrates the 16.948 MHz clock signal supplied by the timing control system 12 to control line 77 of FIG. 6. A waveform 83 illustrates a 1.883 MHz clock signal supplied by the timing control system 12 to control line 76 of FIG. 6. A waveform 84 illustrates a character clock signal supplied by the timing control system 12 to control line 62 of FIG. 6, and a waveform 85 illustrates the Q output of flip-flop 75 of FIG. 6. A waveform 86 illustrates the output of AND gate 83 of FIG. 6.

In operation, upon the occurrence of the trailing edge of a shift bit 8 clock pulse 83*a*, data from the ROM character generator 70 is parallel loaded into the video shift register 72. Concurrently, the leading edge of a bit clock pulse 82*a* triggers the flip-flop 75 to cause the Q output of the flip-flop to transition to a logic one level as illustrated by pulse 85*a*. Upon the occurrence of the leading edge of a next occurring pulse 82*b* of the bit clock signal, the Q output of the flip-flop 75 transitions to a logic zero level as illustrated by the trailing edge of pulse 85*a*. During the time period represented by the pulse width of pulse 85*a*, the Q output of the flip-flop 78 is sampled by gate 74. If the Q outputs of flip-flops 75 and 78 are each at a logic one level, the most significant bit output of video shift register 72 may be applied through gate 73 to the SI input of the video shift register. The output of the gate 73 is loaded into the video shift register 72 upon the occurrence of the leading edge of pulse 82*b*. The video shift register 72 continues to shift data serially to the video drive logic in response to the bit clock illustrated by waveform 82.

Upon the occurrence of the leading edge of a next occurring pulse 83*b* of waveform 83, a next data character is parallel loaded into the video shift register 72. The character time period during which a data character is being serially shifted out of the video shift register 72 is illustrated by the waveform 84, wherein a data character is loaded into the shift register upon the occurrence of the leading edge of pulse 84*a*. A next data character is loaded into the shift register upon the occurrence of the leading edge of a next occurring pulse 84*b*.

In response to the trailing edge of pulse 84*a*, the bit 0 output of register 57 is sampled by gate 83. If the bit 0 output is at a logic one level, the output of the gate 83 transitions to a logic one level as illustrated by pulse 86*a*. The contents of register 57 thereupon are loaded into the register 82 prior to the time that a next character is loaded into the video shift register 72, i.e., the leading edge of pulses 83*b* and 84*b*.

It is to be understood that in the event a character attribute mode is selected, new attribute data shall be loaded into the register 82 for use in conjunction with a character code loaded into the video shift register 72. If a field attribute mode is selected, however, the output of the AND gate 83 as illustrated by waveform 86 shall remain at a logic zero level until such time as the visual attributes associated with the character field are changed.

The invention may be embodied in other specific forms without departing from the spirit or essential characteristics thereof. The present embodiments are therefore to be considered in all respects as illustrative and not restrictive, with the scope of the invention being indicated by the appended claims rather than by the foregoing description. All changes which come within the meaning and range of equivalency of the claims are therefore intended to be embraced therein.

What is claimed is:

1. A video control system for supplying data characters in conjunction with visual attributes to video drive logic controlling the operation of a CRT video screen in a video terminal system having a timing control system, said video control system comprising:

random access memory means for storing character address codes at character-address-code addresses and for storing visual attribute codes, there being a visual-attribute-code address associated with each character-address-code address, each visual attribute code comprising attribute control bits and an attribute-change flag bit;

logic memory means responsive to character address codes issued by said random access memory means for providing binary data character codes;

video information stream logic means receiving said binary data character codes from said logic memory means and responsive to clock control signals generated by said timing control system for converting said binary character codes to a serial video bit stream to be applied to said video drive logic; and visual attribute logic means for receiving visual attribute codes from said random access memory means and responsive to a character clock control signal issued by said timing control system and to said attribute change flag bit for changing and holding a binary visual attribute code and for supplying said binary visual attribute code to said video drive logic until changed in response to an attribute-change flag bit in a subsequent visual attribute code.

2. A video control system for supplying data characters in conjunction with visual attributes to video drive logic controlling the operation of a CRT video screen in a video terminal system having a timing control system, said video control system comprising:

random access memory means for storing character address codes at character-address-code addresses and for storing visual attribute codes, there being a visual-attribute-code address associated with each character-address-code address, each visual attribute code comprising attribute control bits and an attribute-change flag bit;

read only memory (ROM) character generator means responsive to character address codes received from said random access memory means for supplying binary data character codes;

shift register means responsive to clock control signals generated by said timing control system and in electrical communication with said ROM character generator means for converting said binary data character codes into a serial video bit stream for application to said video drive logic; and visual attribute logic means for receiving visual attribute codes from said random access memory means and responsive to a character control signal received from said timing control system and to said attribute-change flag bit for changing and holding a binary visual attribute code and for supplying said binary visual attribute code to said video drive logic until changed in response to an attribute-change flag bit in a subsequent visual attribute code.

3. A video control system for supplying data characters in conjunction with visual attributes to video drive logic controlling the operation of a CRT video screen, said video control system comprising:

random access memory for storing character address codes at character-address-code addresses and for storing visual attribute codes, there being a visual attribute code address associated with each character address code address, each visual attribute code comprising attribute control bits and an attribute-change flag bit;

a character generator responsive to character address codes received from said random access memory for supplying character codes to said video drive logic; and visual attribute logic for receiving visual attribute codes from said random access memory and responsive to said attribute-change flag bit for changing and holding a visual attribute code and for supplying said visual attribute code to said video drive logic until changed in response to an attribute change flag bit in a subsequent visual attribute code, such that the video control system may operate in a character attribute mode in which the attribute-change flag bit is set to change the visual attribute code supplied to the video drive logic with each new character address code applied to the character generator or in a field attribute mode in which the attribute-change flag bit is set to change the visual attribute code applied to the video drive logic after one or more new character address codes are applied to the character generator.

* * * * *